US006152740A

United States Patent [19]

Corrado

[11] Patent Number: 6,152,740

[45] Date of Patent: Nov. 28, 2000

[54] LEARNING BLOCK CHAIR

[76] Inventor: Marylena Corrado, Birth of Venus, 21 Cove St., New Bedford, Mass. 02744

[21] Appl. No.: 09/483,808

[22] Filed: Jan. 15, 2000

[51] Int. Cl.[7] ..... A63H 29/08

[52] U.S. Cl. ..... 434/172; 434/167; 446/75

[58] Field of Search ..... 297/181, 440.14; 446/75, 76, 482; 434/156, 167, 172

[56] References Cited

U.S. PATENT DOCUMENTS

| | | | |
|---|---|---|---|
| 4,057,244 | 11/1977 | Gaspar . | |
| 4,183,154 | 1/1980 | Dykes | 434/167 |
| 4,188,734 | 2/1980 | Rich | 434/172 |
| 4,416,455 | 11/1983 | Munson et al. | 434/172 |
| 5,356,204 | 10/1994 | McDonough | 297/440.14 |
| 5,474,483 | 12/1995 | Sun | 446/75 |
| 5,509,720 | 4/1996 | Croom | 297/440.14 |
| 5,509,844 | 4/1996 | Poirier . | |
| 5,782,185 | 7/1998 | Frahm et al. | 446/75 |
| 5,938,281 | 8/1999 | Keils | 297/181 |
| 5,975,628 | 11/1999 | Russell | 297/440.14 |

OTHER PUBLICATIONS

Pottery Barn Kids, Holiday 1999, p. 37, Pottery Barn Blocks item #07–2211050.

Zany Brainy.Com, (Website) Block Cart item #76939.

*Primary Examiner*—Sam Rimell

[57] ABSTRACT

A learning block chair with a number of removable and rearrangeable blocks is disclosed. The learning block chair includes a seat frame with a top surface and an array of block-receiving apertures therein. A back frame has a front surface with an array of block-receiving apertures therein. The back frame is connected to the seat frame with the top surface of the seat frame being positioned at least 90° relative to the front surface of the back frame. Legs are disposed below the seat frame to support the seat frame. A number of blocks removably reside in the block-receiving apertures in both the seat frame and the back frame. The blocks each have instructional indicia thereon. The blocks are removable and rearrangeable in the block-receiving apertures to create user-defined patterns and arrangements of the blocks.

10 Claims, 4 Drawing Sheets

LEARNING BLOCK CHAIR

BACKGROUND OF THE INVENTION

The present invention relates generally to children's toys and more particularly to a learning block chair that serves as not only a teaching aid but also as an enjoyable toy for a child.

In the prior art, various toys which receive blocks are known. These toys are cumbersome structures that must be removed from a closet or toy box for the child to play with. Due to the effort involved with setting up such a toy for play, the child is less likely to retain interest in that toy or tend to the toy when he or she is finished playing with it. In addition, prior art block toys are designed specifically for receiving and holding blocks alone. Such a single purpose makes interest in the toy wane quickly.

In view of the foregoing, there is a demand for a children's block toy that is interesting and fun to use while serving a purpose other than just a block toy. There is a further demand for a child's toy that is suitable for display at all times and in preparation for use at any time.

SUMMARY OF THE INVENTION

The present invention preserves the advantages of prior art children's block toys. In addition, the children's block chair of the present invention provides new advantages not found in currently available block toys and overcomes many of the disadvantages of such currently available block toys.

The present invention is directed to a novel and unique learning block chair. The learning block chair of the present invention includes a number of removable and rearrangeable blocks. The learning block chair includes a seat frame with a top surface and an array of block-receiving apertures therein. A back frame has a front surface with an array of block-receiving apertures therein. The back frame is connected to the seat frame with the top surface of the seat frame being positioned at least 90° relative to the front surface of the back frame. Legs are disposed below the seat frame to support the seat frame. A number of blocks removably reside in the block-receiving apertures in both the seat frame and the back frame. The blocks each have instructional indicia thereon. The blocks are removable and rearrangeable in the block-receiving apertures to create user-defined patterns and arrangements of the blocks.

Accordingly, an object of the present invention is to provide a block toy that serves not only as a toy but as a functioning chair.

Another object of the present invention is to provide a learning block chair that is suitable for display at all times in preparation for use.

A further object of the present invention is to provide a learning block chair that includes an instructional tool for children.

Yet a further object of the present invention is to provide a toy that enables the user to easily and prominently display what they have created by their own arrangement of the removable and rearrangeable blocks.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
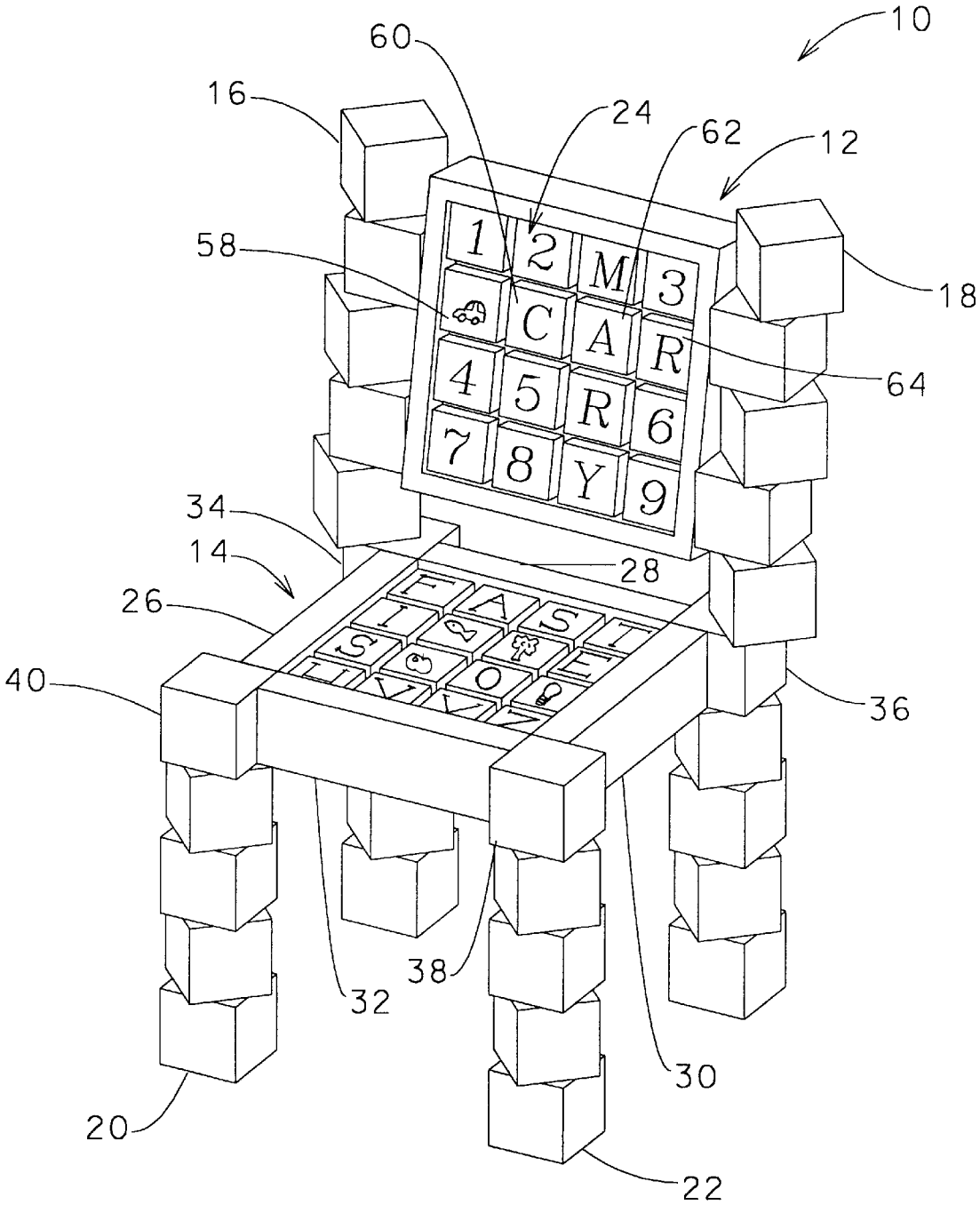
FIG. 1 is a perspective view of the preferred embodiment of the learning block chair of the present invention with blocks in place.

As shown in FIGS. 1–4, the present invention provides a learning block chair as indicated generally by the numeral 10. Viewing a learning block chair 10 in more detail, it is seen that in the design or embodiment illustrated in the drawings that the same includes two support frame structures, a seat frame indicated generally by the numeral 14 and back frame indicated generally by the numeral 12. Both support frame structures 14 and 12 house a number of play blocks indicated generally by the numeral 24. Two front legs are indicated by the numerals 20 and 22. Two back legs are indicated by the numerals 16 and 18. Optionally, less than four or greater than four legs may be employed. Also, other types of support members, such as spheres, can be employed depending on the desired appearance of the chair 10.

Referring specifically to FIG. 1, a seat frame 14, as shown herein, includes an outer square framework consisting of four stretchers 26, 28, 30 and 32 secured or molded to corner members 34, 36, 38 and 40 in any suitable manner, creating a framework to support a seat block housing lattice 42 and a seat block support lattice 44. Corner members 34, 36, 38 and 40 are illustrated as being block-like in configuration but may be of other shapes to suit the desired appearance of the chair 10.

Figure 2:
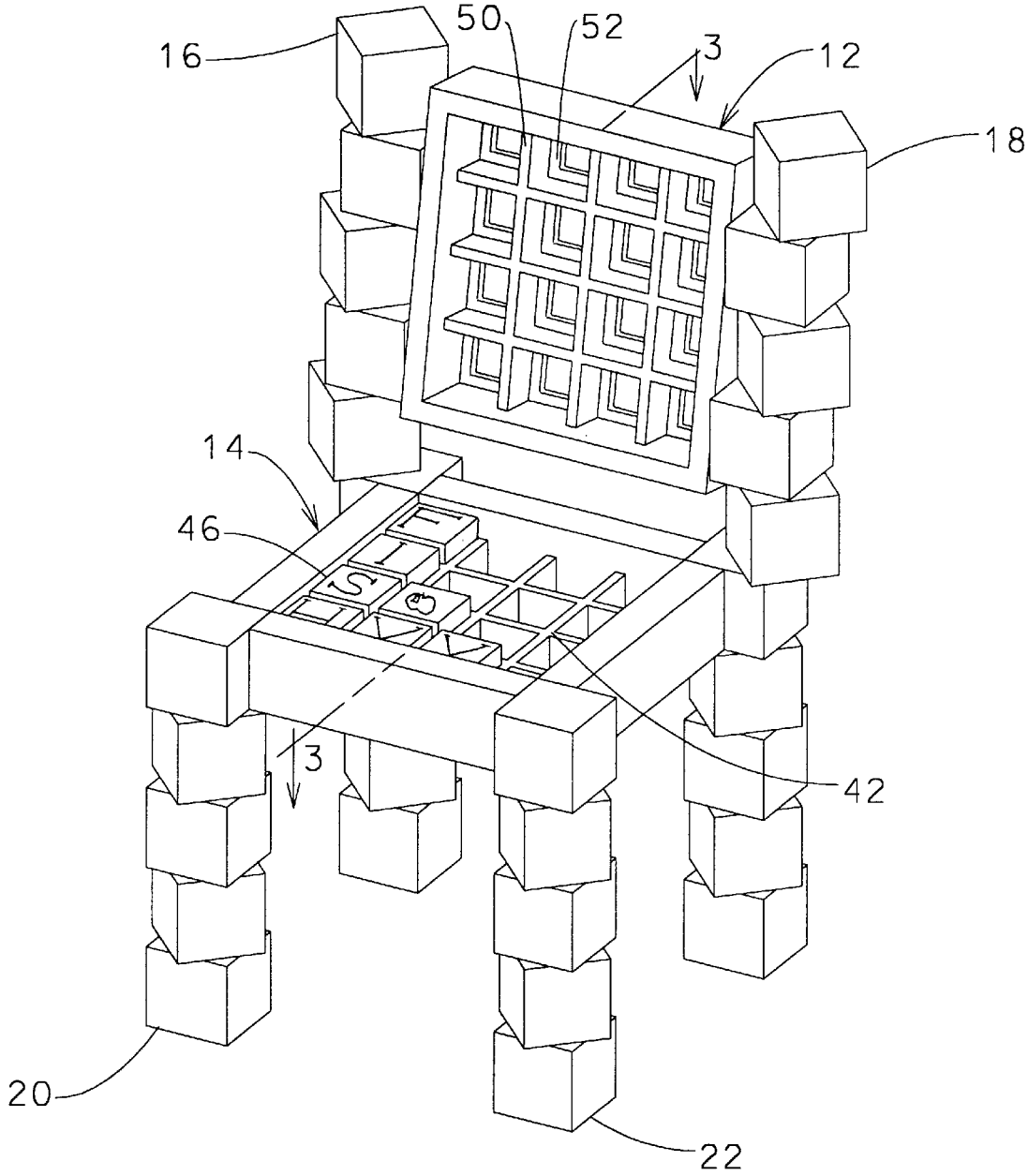
FIG. 2 is a perspective view of the learning block chair of FIG. 1 with some blocks removed to show the system of the back and seat support frame structures.
Figure 3:
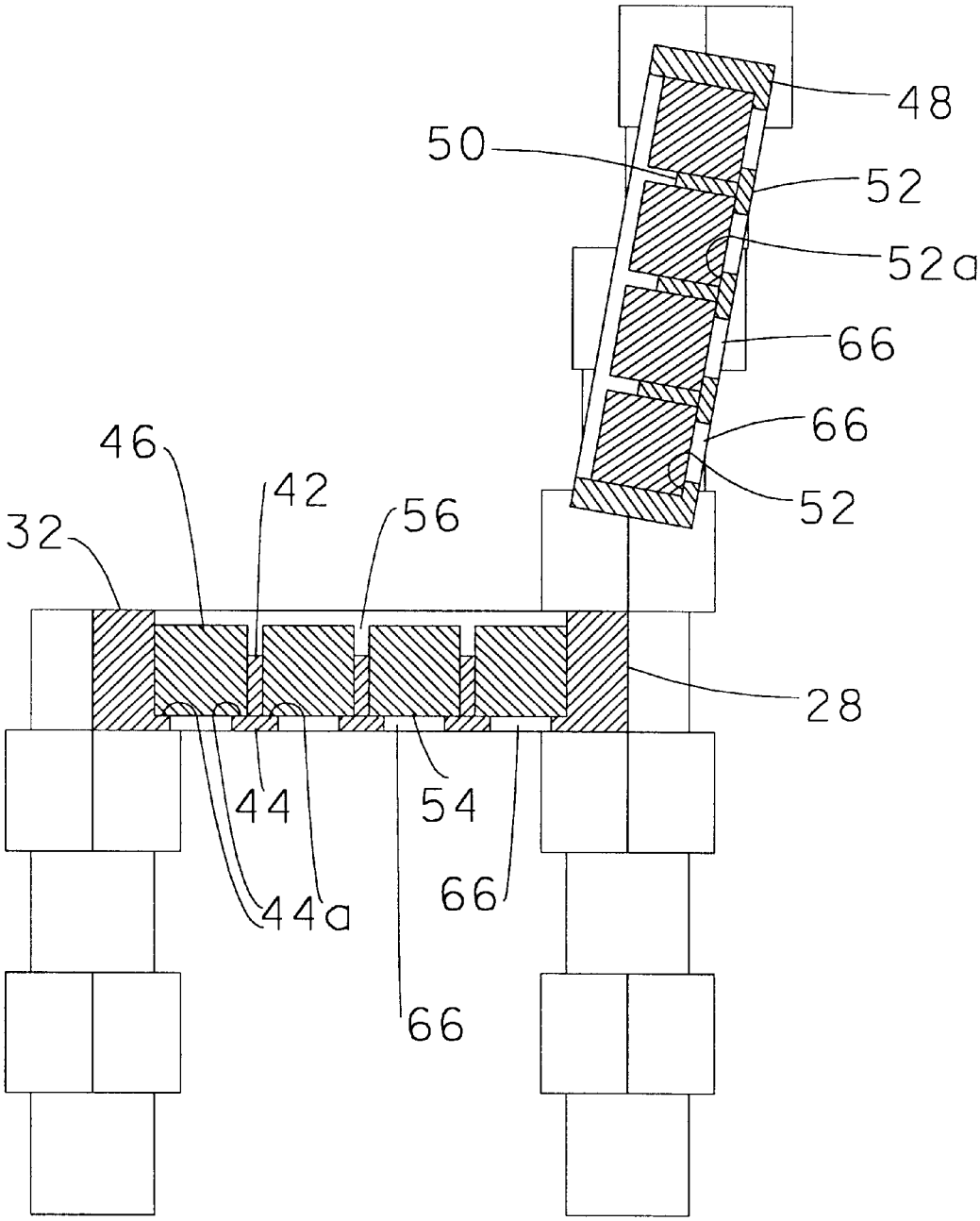
FIG. 3 is a partial cross-sectional view through the line 3—3 of FIG. 2.

As shown in FIGS. 2 and 3, a seat block housing lattice 42 is mortised or molded into the seat framework 14 for stability and provides compartments for removably receiving toy blocks 24 therein. The seat block support lattice 44 is attached or molded to the underside of the seat block housing lattice 42 in any suitable manner, to create a ledge 44*a* for support of toy blocks 24. Note, in particular, that the toy blocks 24 are specifically designed such that a toy block will match the size and shape of any opening in the seat block housing lattice 42. It is appreciated that the seat block housing lattice 42 is designed to accept any individual toy block 24 upon vertical insertion thereof. The toy block 46 is secured by simply sliding a block 46 downwardly to where the bottom rests flush against the seat block support lattice 44 and in communication with respective ledges 44*a*.

The toy blocks 24, and particularly an individual toy block 46, can be easily removed from the support frame structure 14 when it is pushed from the underside 54 via apertures 66. Also, the seat block housing lattice 42 is sized so that space 56 is left around the upper portion of the toy blocks 24 so one can easily fit his or her fingers around it and grasp the toy block 46 for an alternate way to remove the block from their respective seats.

The back support frame structure 12 is designed in the same way as the seat support frame structure 14. It is comprised of a simple outer square framework 48 which contains a back block housing lattice 50 and a back block support lattice 52 which are identical to the seating lattice's 42 and 44. The back lattice's 50 and 52 are attached or molded to a back outer square framework 48 in any suitable manner. Note that the back support frame structure 12 is attached at an angle to the rear legs 16 and 18. The back support frame is, preferably, positioned at least 90° relative to the seat support frame. This angle serves two purposes. The first is to use gravity to keep the toy blocks 24 in place, and the second is to create a more comfortable seating position. The toy blocks 24 are inserted horizontally into the back support frame structure 12 as opposed to vertically in the seat support frame structure 14. Gravity keeps the toy blocks 24 in place when they rest flush against the back block support lattice 52 and secured by ledges 52*a*. The toy blocks 24 can be easily removed from the back support frame structure 12 with the same approach as in the seat support frame structure 14. The blocks can be pushed from the backside and grasped from the front where space is provided around the front portion of the block.

It is appreciated that when all toy blocks are inserted in the seat support frame structure 14, they create a surface or seat which can support the weight of a person because the outer surfaces of the installed blocks 24 in the seat support frame lie in approximately the same plane and the outer surfaces of the installed blocks 24 in the back support frame lie in approximately the same plane. It is appreciated that when all blocks are inserted in the back support frame structure 12, they create a surface or back which can support the weight of a person. Note that all outer edges of blocks and frames are typically beveled or rounded to avoid snagging and personal injury.

The legs 16, 18, 20 and 22 in this preferred embodiment are made up of blocks which are doweled or molded together. The blocks of the legs are stationery and serve an aesthetic role as well as structural. The legs 16, 18, 20 and 22 are connected to the seat 14 and back 12 in any suitable manner. In other embodiments the legs may be replaced with a straight piece of wood rather than blocks, as long as they support the seat 14 and back 12 and the weight of a person.

Figure 4:
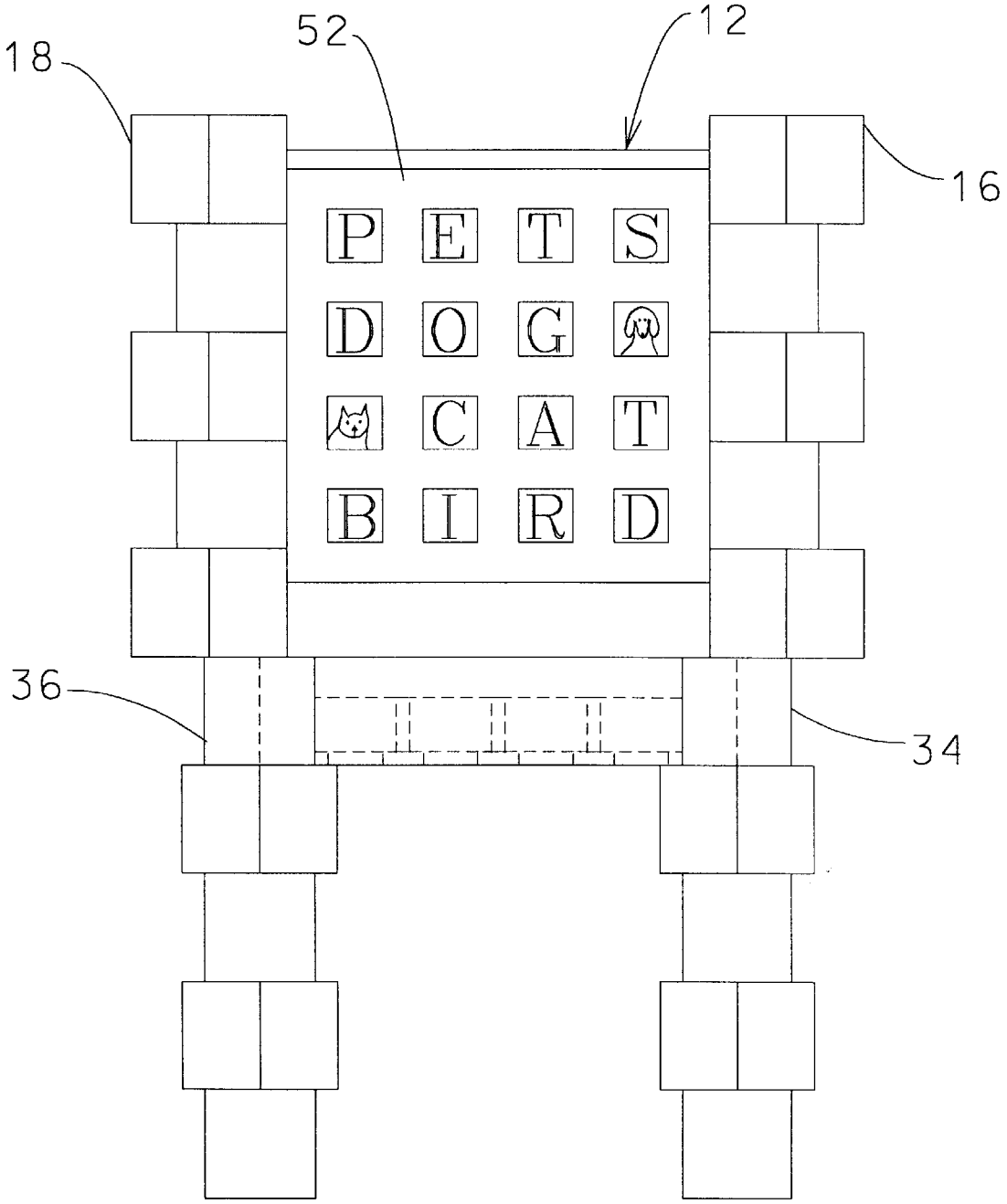
FIG. 4 is a rear elevational view of the learning block chair shown in FIG. 1.

All sides of the respective toy blocks 24 have either a letter of the alphabet, a numeral, or a picture drawn or formed thereon. For example, block 58 has an image of a car drawn on it and 60, 62, and 64 are arranged to spell out the word "car". Again, it is appreciated that the unexposed faces of the toy blocks 24 would also include other letters of the alphabet, numerals, or drawings. Therefore it is appreciated that each of these toy blocks 24 can be removed from the chair, rotated, reinserted and/or rearranged to expose additional letters, numerals, and pictures. The toy blocks can be viewed from the top of the seat, the front of the chair, as in FIG. 1, and from the back of the chair as shown in FIG. 4. The present invention contemplates that all letters of the alphabet will form a part of the total chair. The present invention also contemplates that numerals 0 to 9 will form a part of the total chair. It is also possible that mathematical symbols such as plus (+), minus (−), or equals (=) will form a part of the total chair. The present invention also contemplates that simple pictures such as an automobile, animal, food, or everyday objects will form a part of the total chair. The preferred embodiment contains thirty-two toy blocks 24, but another embodiment may contain more or less toy blocks.

The toy blocks 24 can be removed from the seat 14 and back 12 for rearrangement in the chair. They can also be used and played with individually or together outside of the chair. In both ways the toy blocks 24 can be used as an educational tool to teach the letters of the alphabet and numerals. The toy blocks 24 can also be used to teach spelling and word recognition. A child can see a picture of an object and verbalize its name. For example, a child will see the picture of a car 58 and say aloud or think about the letters that make up the word "car". He or she will then be able to find those letters and place them in the seat or back to spell out the word car 60, 62, 64. In addition, the blocks in a separated mode can be handled, carried, or stacked to build other basic block-type structures. When the child is finished playing with the toy blocks 24, they can be reinserted into the chair, and stored for future use. When not being played with, the chair can be sat on and serve its purpose as a functional chair or also be used to display new words each week. This will help reinforce language skills within a child and provide parents with a functional educational tool. The learning block chair also teaches children to put away their toys by requiring them to replace the blocks in order for the chair to function as a comfortable sitting surface.

While the learning block chair of the preferred embodiment can be constructed of various materials, it is contemplated that in a preferred design the toy blocks 24 and the chair structure would be built of wood or formed of molded plastic. The materials would be designed to provide strength, yet also lightweight so that the chair and toy blocks 24 can be easily removed, handled, and manipulated by a child. It should be understood that other materials may be used to facilitate manufacture or improve appearance of the chair 10.

From the foregoing specification and discussion it is appreciated that the learning block chair of the present invention presents a very dynamic and intriguing toy and educational tool for a child. Not only can a child learn the letters of the alphabet, numerals, and spelling, but the learning block chair also serves as a storage display for its toy blocks 24 while functioning as an aesthetically pleasing chair.

It is appreciated that although the present invention shows a specific design that includes a certain number of blocks, the learning block chair of the present invention can be designed in other specific ways and the number of toy blocks utilized may vary. For example, the chair may match a table which also embodies the invention, serving the purpose of a table, but also a storage for the blocks and a surface on which they can be rearranged. The present invention may also be used to create adult sized furniture.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A learning block chair, comprising:

a seat frame having a top surface with an array of block-receiving apertures therein;

a back frame having a front surface with an array of block-receiving apertures therein; said back frame being connected to said seat frame with said top surface of said seat frame being positioned at least 90° relative to said front surface of said back frame;

leg means disposed below said seat frame for supporting said seat frame;

a plurality of blocks removably residing in said block-receiving apertures in said seat frame and said back frame; said plurality of blocks each having instructional indicia thereon.

2. The learning block chair of claim 1, wherein said seat frame and said back frame each have block-receiving apertures configured in an array that has an equal number of block-receiving apertures across as from top to seat of each respective seat frame and back frame.

3. The learning block chair of claim 1, wherein each of said plurality of blocks are a cube in configuration.

4. The learning block chair of claim 1, wherein each of said plurality of blocks, when seated in said block-receiving apertures in said seat frame, include an outer surface that are substantially co-planar with one another so as to define a seat support plane.

5. The learning block chair of claim 1, wherein each of said plurality of blocks, when seated in said block-receiving apertures in said back frame, include an outer surface that are substantially co-planar with one another so as to define a back support plane.

6. The learning block chair of claim 1, wherein said plurality of blocks are removable and rearrangeable in said block-receiving apertures to create user-defined patterns and arrangements of said plurality of blocks.

7. A learning block chair, comprising:

a seat frame having a top surface with an array of block-receiving apertures therein;

a back frame having a front surface with an array of block-receiving apertures therein; said back frame being connected to said seat frame with said top surface of said seat frame being positioned at least 90° relative to said front surface of said back frame;

leg means disposed below said seat frame for supporting said seat frame;

a plurality of blocks removably residing in said block-receiving apertures in said seat frame and said back frame; said plurality of blocks each having instructional indicia thereon; each of said plurality of blocks, when seated in said block-receiving apertures in said seat frame, include an outer surface that are substantially co-planar with one another so as to define a seat support plane and each of said plurality of blocks, when seated in said block-receiving apertures in said back frame, include an outer surface that are substantially co-planar with one another so as to define a back support plane; said plurality of blocks being removable and rearrangeable in said block-receiving apertures to create user-defined patterns and arrangements of said plurality of blocks.

8. The learning block chair of claim 7, wherein said seat frame and said back frame each have block-receiving apertures configured in an array that has an equal number of block-receiving apertures across as from top to seat of each respective seat frame and back frame.

9. The learning block chair of claim 8, wherein each of said plurality of blocks are a cube in configuration.

10. The learning block chair of claim 8, wherein each of said plurality of blocks including a rear surface opposite said outer surface; said rear surface of each of said plurality of blocks being visible through said seat frame and said back frame, respectively.

* * * * *